United States Patent [19]

Teich et al.

[11] Patent Number: 4,507,531

[45] Date of Patent: Mar. 26, 1985

[54] REGULATED MICROWAVE OVEN AND METHOD, USING UNIFORMLY SPACED, INTEGRAL CYCLE CONTROL

[75] Inventors: Wesley W. Teich, Wayland; Joseph R. Adamski, Brighton, both of Mass.

[73] Assignee: Raytheon Company, Lexington, Mass.

[21] Appl. No.: 562,047

[22] Filed: Dec. 16, 1983

Related U.S. Application Data

[62] Division of Ser. No. 317,022, Oct. 30, 1981, abandoned.

[51] Int. Cl.[3] ..... H05B 6/68

[52] U.S. Cl. ..... 219/10.55 B; 219/10.55 M; 323/319

[58] Field of Search ..... 219/10.55 B, 10.55 M; 323/235, 236, 319; 363/86, 88; 328/262; 307/252 UA

[56] References Cited

U.S. PATENT DOCUMENTS

| | | | |
|---|---|---|---|
| 3,562,625 | 2/1971 | van den Broek | 363/88 |
| 3,890,562 | 6/1975 | West | 323/235 |
| 4,012,617 | 3/1977 | Burke et al. | 219/10.55 B |
| 4,334,147 | 6/1982 | Payne | 323/235 |
| 4,374,321 | 2/1983 | Cunningham et al. | 323/235 |
| 4,377,739 | 3/1983 | Eckert et al. | 323/235 |
| 4,390,768 | 6/1983 | Teich et al. | 219/10.55 B |
| 4,420,668 | 12/1983 | Larsen et al. | 219/10.55 B |

OTHER PUBLICATIONS

IEEE Transactions on Industrial Electronics & Control Instrumentation, vol. IECI-25, No. 2, pp. 149-154, S87580072, (May 78).

*Primary Examiner*—Philip H. Leung

*Attorney, Agent, or Firm*—William R. Clark; Joseph D. Pannone

[57] ABSTRACT

A method and apparatus for regulating a microwave oven to a predetermined output power level. The anode current or a voltage corresponding to it is monitored to provide a signal indicative of the actual output power of the magnetron. Time is divided into a sequence of equal time intervals, each interval corresponding to fixed number of ac line cycles. In accordance with the signal, the number of ac cycles to be supplied to the power supply for each interval to regulate the output power towards the regulated level is determined. The determined number of cycles are supplied by switching at the zero current crossings between the line and the power supply. The switching is executed so that the supplied ac cycles are distributed substantially uniformly over the particular time interval.

16 Claims, 10 Drawing Figures

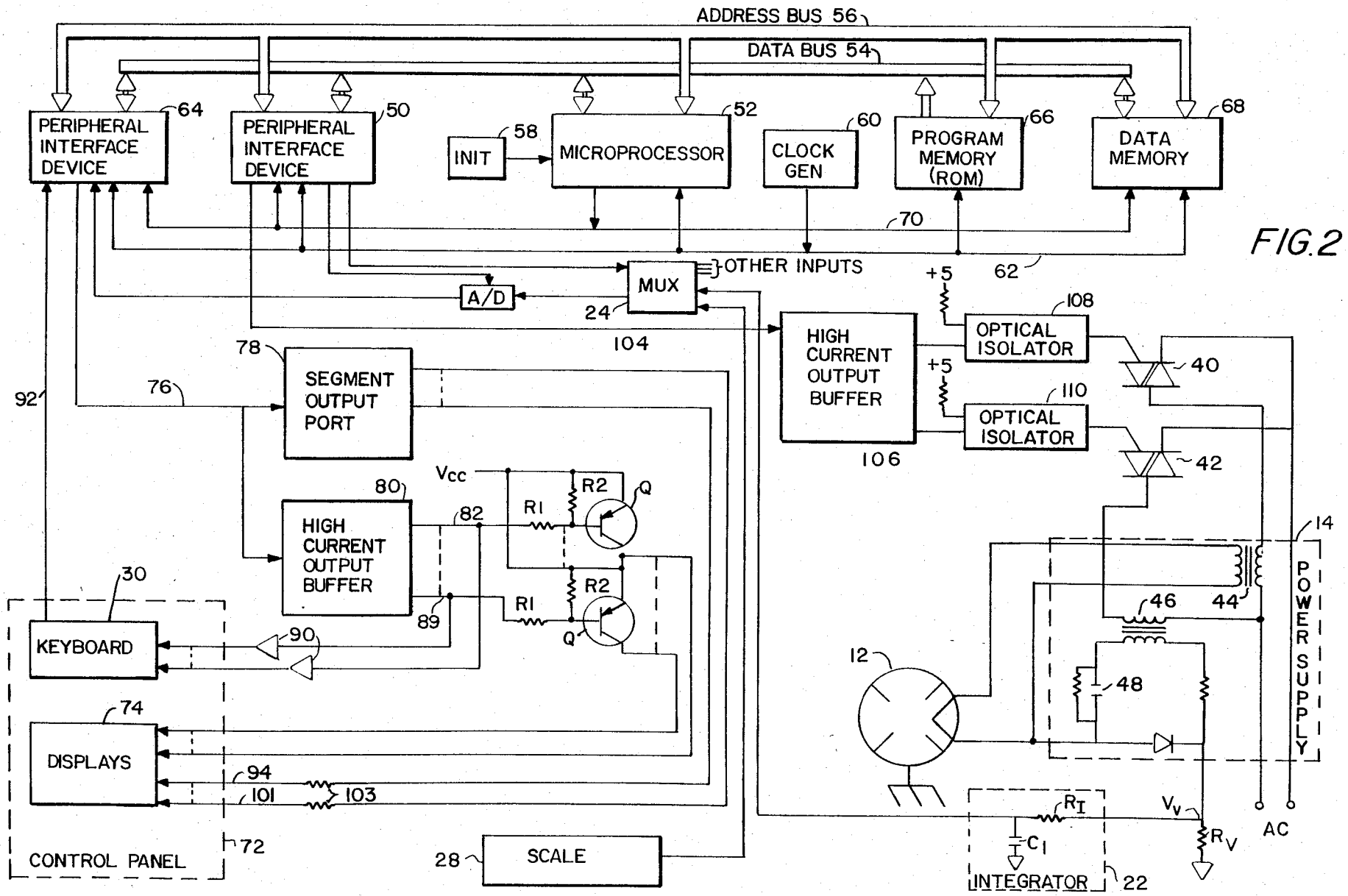
FIG.2
ADDRESS BUS 56
DATA BUS 54
DATA MEMORY
68
PROGRAM MEMORY (ROM)
66
CLOCK GEN
60
MICROPROCESSOR
52
INIT
58
PERIPHERAL INTERFACE DEVICE
50
PERIPHERAL INTERFACE DEVICE
64
62
70
OTHER INPUTS
MUX
24
A/D
104
OPTICAL ISOLATOR
108
OPTICAL ISOLATOR
110
+5
+5
HIGH CURRENT OUTPUT BUFFER
106
40
42
POWER SUPPLY
14
AC
44
46
48
12
$R_V$
$V_V$
22
$R_I$
$C_I$
INTEGRATOR
SCALE
28
Q
Q'
R2
R1
R2
R1
$V_{CC}$
82
89
SEGMENT OUTPUT PORT
78
HIGH CURRENT OUTPUT BUFFER
80
90
103
94
101
72
76
92
30
KEYBOARD
74
DISPLAYS
CONTROL PANEL

REGULATED MICROWAVE OVEN AND METHOD, USING UNIFORMLY SPACED, INTEGRAL CYCLE CONTROL

This application is a division of application Ser. No. 317,022 filed Oct. 30, 1981, now abandoned.

BACKGROUND OF THE INVENTION

There is considerable variation in cooking times among microwave ovens even when considering only a particular model of a given manufacturer. The dominant factor for this variation is differences in the output powers of the magnetrons of the respective ovens; these differences result primarily from differences in the powers provided by their respective power supplies. The power delivered to the magnetron in the nearly universal power supply design depends on the effective turns ratio of the plate transformer and the effective value of the storage capacitor. While it would be possible to measure and pair these components to produce a standard plate current, the process for doing such would be very expensive. Further, the power output of a given power supply would vary substantially as a function of ac line voltage which typically may vary by as much as 30% in domestic applications. It would be possible to overcome the output variance as a function of ac line voltage, but the precision power supply required would be prohibitively expensive. In short, the relatively inexpensive power supply design used in most domestic microwave ovens results in ovens of the same model producing various output powers even when operated with a regulated ac line voltage. For example, magnetron output powers supplied by the power supplies with a regulated ac line voltage for a particular model may vary from 600–750 watts with an average of approximately 670 watts. Further, an individual oven will exhibit a significant swing in output power as a result of changes in the ac line voltage.

Variation in microwave cooking times described heretofore has created problems for the microwave cooking industry. For example, manufacturers of prepackaged foods are unable to provide accurate cooking directions and may lose customers if the results are not satisfactory. Also, the user precisely following a cook book recipe and the cooking time provided therein will be dissatisfied if the food is overdone or underdone. Furthermore, with state of the art cook-by-weight ovens, the microprocessor algorithm for calculating cooking times preferably includes a term derived from the predicted output power of the magnetron.

The cooking time variance with microwave ovens is much more critical than with conventional gas or electric ovens where the cooking times are substantially a function only of the accuracy of the thermostat; the times do not vary additionally as a function of the ac line voltage. Further, in most conventional ovens, inconsistencies between the oven temperature and the dial set temperature can be corrected by a simple adjustment to the dial. Also, users have developed an understanding for how to compensate conventional cooking times when the oven is consistently not hot enough. However, the same understanding is generally not present with users who may be new to microwave cooking; this is especially true in view of the cooking time variation with a given microwave oven as a function of the ac line voltage.

From the foregoing, it is apparent that it is desirable to provide microwave ovens having constant uniform output powers to establish standard predictable cooking times. One prior art approach to the general problem of non-uniform cooking times is to monitor the ac line voltage and recalculate the preset cooking time as a function thereof. Although this approach may provide some improvement for the cooking time variation as a function of a varying ac line voltage, it provides no correction for cooking time variation caused by differences in components of the power supplies of respective microwave ovens.

SUMMARY OF THE INVENTION

The invention discloses the combination of an ac to dc power supply, means for providing a signal corresponding to the output power of the power supply, and means responsive to the signal for varying the number of ac cycles supplied to the power supply during sequential time intervals, each interval corresponding to a fixed number of ac line cycles, the supplied ac cycles for a given time interval being distributed substantially uniformly thereover. It may be preferable that the varying means comprises a microprocessor. Also, the varying means may preferably comprise a switch connected between the ac line and the supply. Further, it may be preferable that the fixed number of ac line cycles be fewer than 150 cycles. Also, it may preferable that substantially uniform distribution defines that when more than half the ac cycles are supplied during one of the time intervals, two cycles are not omitted in sequence. Conversely, if fewer than half the ac cycles are to be supplied, it may be preferable that two ac line cycles are not supplied in sequence. Absolute uniform distribution would mean that the supplied line cycles are time shifted before being supplied to the power supply so that there is a constant time period between supplied cycles. However, substantially uniform distribution is intended to also include the case where particular line cycles are omitted by opening a switch; the cycles which are coupled to the power supply are not time shifted. More specifically, it is intended to minimize the number of consecutive cycles when the switch is open and power is not coupled to the power supply. By minimizing the number of consecutive off cycles, domestic light flickering is reduced. It may be preferable that the switch be opened and closed at approximately the line zero current crossing; for a substantially inductive load, these will occur after the line zero voltage crossing.

The invention may also be practiced by the combination of an ac to dc power supply, means for generating a signal corresponding to the power delivered by the power supply, means responsive to the signal for determining the number of ac cycles to be supplied to the high voltage transformer of the power supply during a time interval corresponding to a predetermined number of ac line cycles wherein the power delivered is regulated towards a predetermined level, and means for supplying the number of ac cycles to the high voltage transformer in substantially uniform distribution over the time interval.

The invention teaches the method of regulating the output power of an ac to dc power supply to a predetermined output power, comprising the steps of generating a signal corresponding to the output power of the power supply, determining how many of a sequential predetermined number of ac line cycles are to be supplied to the power supply to vary the output power towards the predetermined output power, and supplying the determined number of ac cycles to the power supply in substantially uniform distribution over the time period of the sequence of the predetermined number of ac line cycles.

The invention also discloses the method of regulating the output power of an ac to dc power supply towards a predetermined power level, comprising the steps of supplying a predetermined number of ac cycles to the power supply during a first time period corresponding to a fixed number of ac line cycles, generating a signal corresponding to the actual output power of the power supply, determining the magnitude of difference between the predetermined power level and the actual power level, deriving the number of ac cycles to be supplied to the power supply during a second time period to regulate the actual output power towards the predetermined power level, the magnitude of regulation being a function of the difference magnitude, the second time period being equal to and following the first time period, and supplying the derived number of ac line cycles during the second time period.

The invention may also be practiced using a microwave oven comprising a magnetron, a power supply connected to the magnetron, means for generating a signal corresponding to the anode current drawn from the power supply by the magnetron, and means responsive to the signal for varying the power supplied to the magnetron by the power supply. It may be preferable that the generating means comprises a resistor between the power supply and dc ground. It may also be preferable that the generating means further comprise means for time averaging the voltage across the resistor. A typical time average may be over approximately one second. Also, the varying means may comprise a microprocessor which preferably recalculates the power to be supplied during successive intervals of equivalent time.

When the invention is used in the application of a microwave oven, it may be defined as a microwave oven comprising a magnetron, a power supply connected to the magnetron, means for generating a signal corresponding to the anode current drawn from the power supply by the magnetron, and means responsive to the signal for incrementally regulating the anode current towards a predetermined level, the time intervals between incremental regulations being constant and corresponding to a fixed number of ac line cycles. It is preferable that the magnitude of the incremental regulations be a function of the difference between the signal and a predetermined value. In other words, it may preferable that the magnitude of the regulation be greater when the signal has a greater difference from the predetermined value.

The invention may also be practiced by a microwave oven comprising a magnetron, a power supply connected to the magnetron, means for generating a signal corresponding to the anode current drawn from the power supply by the magnetron, and means responsive to the signal for regulating the anode current toward a predetermined level, the regulating means comprising means for varying the number of ac cycles supplied to the high voltage transformer of the power supply during sequential time intervals each corresponding to a fixed number of ac line cycles, the supplied ac cycles for a given time interval being distributed substantially uniformly over the given time interval. Preferably, the signal corresponds to the average current drawn by the magnetron. Also, substantially uniform distribution provides that when more than half the ac line cycles of a given time period are to be supplied to the high voltage transformer, two ac line cycles are not skipped sequentially. In other words, a switch between the line and the high voltage transformer is not open for two consecutive cycles.

The invention discloses the method of regulating the output power of a microwave oven to a standard output level, comprising the steps of providing a signal corresponding to the time averaged anode current drawn by the magnetron from the high voltage power supply, periodically determining the magnitude of difference between a calculated actual output level and the standard output level, the calculated level being derived in response to the signal, determining in response to the magnitude of difference the number of ac line cycles in the next of a sequence of time intervals to be supplied to the power supply, each of the time intervals being a fixed predetermined number of ac line cycles in length, and supplying the number of cycles substantially uniformly over the next time interval to the power supply.

BRIEF DESCRIPTION OF THE DRAWINGS

The foregoing and other objects and advantages of the invention will be more readily understood by reading the following Description of the Preferred Embodiment with reference to the drawings wherein:

FIG. 2 is a hardware implementation of the diagram of FIG. 1;

DESCRIPTION OF THE PREFERRED EMBODIMENT

It has been determined that the power output from a magnetron is fundamentally proportional to the anode current that is drawn. Further, it was determined that even with a drifting AC line voltage, the anode current or a voltage corresponding to it could be sampled and the duty cycle of the magnetron controlled in accordance therewith to provide a microwave oven with stable output power. Also, similar design microwave ovens could provide substantially the same output power so that cooking times for foods could be much more precisely specified. In short, the power outputs of microwave ovens could be made constant and uniform among the ovens by regulating the respective power supplies.

Figure 1:
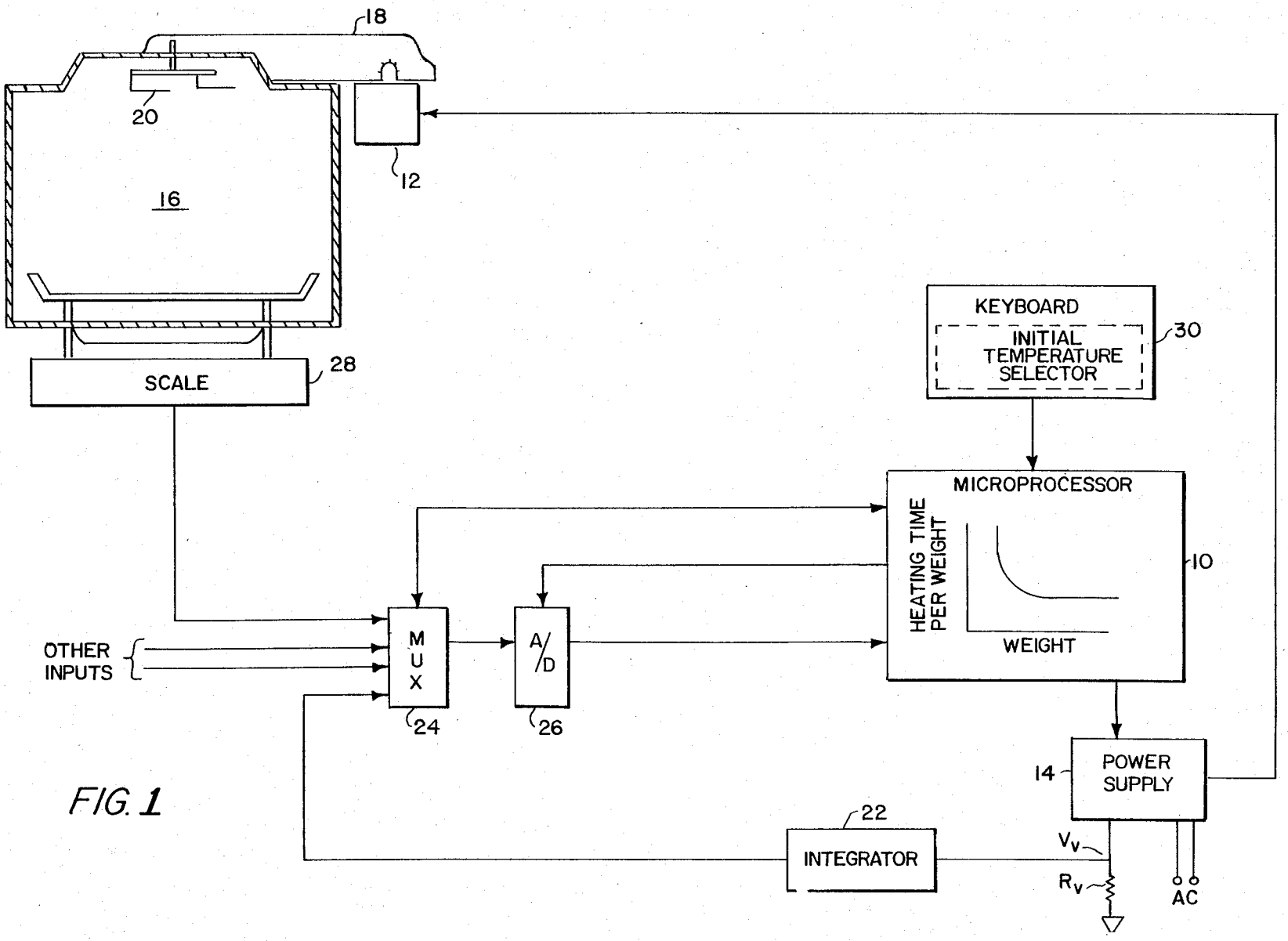
FIG. 1 is a block diagram/schematic of a microwave oven embodying the invention.

Referring to FIG. 1, there is shown a block diagram/schematic of a microwave oven embodying the invention. In response to pulsed high voltage from power supply 14, magnetron 12 supplies pulsed microwave energy to waveguide 18. The microwave energy is coupled to cavity 16 by a rotating primary radiator 20 which preferably provides a plurality of directive radiation patterns. Microprocessor 10 controls the average output power of magnetron 12 by regulating power supply 14. More specifically, microprocessor 10 regulates the number of ac cycles supplied to power supply 14 in sequential 100 cycle intervals and thereby reduces the maximum number of high voltage pulses supplied to magnetron 12 during a given time period. A preferred embodiment of the specific interconnections between these components and the other components of FIG. 1 will be described in detail later herein with reference to FIG. 2.

A small resistance viewing resistor $R_V$ is connected between the high voltage supply of power supply 14 and its ground to provide a viewing voltage $V_v$ which is proportional to the anode current drawn. Voltage $V_v$ is connected to integrator 22 to provide appropriate time averaging. The time averaging is important for two reasons. First, as described earlier herein, the anode current drawn through resistor $R_v$ is pulsed so that voltage $V_v$ is also pulsed. Second, the anode current fluctuates as a result of variations in the loading on the magnetron caused by the rotation of primary radiator 20. Accordingly, integrator 22 provides an average voltage that is proportional to the average anode current. Integrated voltage $V_v$ is coupled to multiplexer 24. At appropriate time intervals, microprocessor 10 selects integrated voltage $V_v$ through multiplexer 24 for conversion to a digital signal by A/D converter 26 and input to microprocessor 10. Stated simply, if integrated voltage $V_v$ which corresponds to the average anode current is larger than the value required to regulate to the desired power setting, microprocessor 10 reduces the number of ac cycles supplied to the power supply for the next time interval. Conversely, if integrated voltage $V_v$ is less than required, the number of ac cycles supplied in the next time interval is increased from the prior interval. An embodiment of hardware implementation will be described in detail later herein.

In accordance with the invention, the apparatus described heretofore has significant advantage over prior art microwave ovens in that constant uniform output powers are provided. By constant, it is meant that a particular microwave oven unit exhibits substantially the same or stable output power for different ac line voltage inputs. By uniform, it is meant that different microwave ovens of the same or similar design provide substantially the same output powers. The constant uniform output powers mean that the cooking times for the ovens can be precisely specified.

Regulation of the output power has particular advantage in a microwave oven that determines the cooking time as a function of weight. More specifically, if the weight of the food is input to microprocessor 10 and an algorithm is used to determine the cooking time, the algorithm preferably has a term derived from the output power of the magnetron. However, if the output power is not accurately known or varies as a function of the ac line voltage, the cooking time cannot be accurately calculated. Still referring to FIG. 1, scale 28 provides an analog signal corresponding to the weight of the food in microwave cavity 16. This signal is selected through multiplexer 24 for conversion to a digital signal by A/D converter 26 in preparation for input to microprocessor 10. From the initial weight of the food and an operator input through keyboard 30 corresponding to the initial temperature of the food, microprocessor 10 accurately determines the cooking time.

Referring to FIG. 2, a hardware embodiment of the block diagram of FIG. 1 is shown. Triacs 40 and 42 function as switches and respectively determine whether ac line voltage is delivered to heater transformer 44 and high voltage transformer 46. In normal operation, heater triac 40 is closed a few seconds before high voltage triac 42 and is left on continuously during operation while high voltage triac 42 is used to regulate the number of ac cycles supplied to high voltage transformer 46 during each 100 cycle interval. As shown, the secondary of heater transformer 44 is connected to the heater of magnetron 12. The high voltage supply of power supply 14 is a conventional voltage doubler circuit that is in wide usage. More specifically, during half of the ac cycle, capacitor 48 is charged up to approximately −2000 volts. Then, in the second half of the ac cycle, the charge on capacitor 48 adds with the secondary voltage on transformer 46 providing a voltage of approximately −4000 volts to the cathode of magnetron 12. This high voltage causes current to be drawn from the power supply ground through viewing resistor $R_v$ through the magnetron to the anode. Voltage $V_v$ is therefore directly proportional to the anode current drawn. For a particular combination of magnetron, feed structure, and cavity it was found preferable to regulate the anode current to average 300 milliamps for full power operation. Further, it was found preferable that the 300 milliamp average correspond to an average or integrated $V_v$ voltage of 2.2 volts. This was satisfied by selecting a value of approximately 7.3 ohms for $R_v$. Also, it was found preferable that integrator 22 which time averages $V_v$ comprise an RC filter having a time constant of approximately one second. Accordingly, the respective values for $R_I$ and $C_I$ may preferably be 1 megaohm and 1 microfarad. Integrator 22 smooths out the pulsed operation curve of magnetron 12 which may typically have a duty cycle of approximately 0.3. Also, integrator 22 compensates for fluctuations in the anode current drawn resulting from different load conditions as the primary radiator rotates. The integration of voltage $V_v$ is coupled to multiplexer 24 and is selected therethrough in response to microprocessor control as governed by peripheral interface device 50. Also coupled to multiplexer 24 is an analog signal from scale 28 which may be used in a cook-byweight algorithm. Also, other analog inputs such as a temperature probe may be sampled through multiplexer 28.

For commercial applications, it may be preferable that the microprocessor control be provided by a customized integrated circuit which includes therein many of the interface functions. The embodiment of FIG. 2 shows a general purpose microprocessor 52 with ancilliary hardware and interfaces coupling it to the microwave oven control panel, sensors, and magnetron control. An example of microprocessor 52 that could be used is an MOS Technology, Inc. MCS6502. As shown in FIG. 2, the microprocessor is connected to data bus 54 which typically comprises eight lines which may be connected to MCS6502 pins 26–33, respectively. The microprocessor is also connected to address bus 56 which typically comprises sixteen lines which may be connected to MCS6502 pins 9–25, respectively. Conventional initiating circuitry (INIT) 58 is used only at power up time by the microprocessor and may be connected to input pins 6 and 40 of microprocessor MCS6502. Further, a conventional crystal clock (CLOCK GENerator) 60 is required and may be input to the microprocessor on pins 37 and 39. Line 62 is used to provide the clock to peripheral interface devices 50 and 64, program memory (ROM) 66 and data memory (RAM) 68. Microprocessor 52 provides the same functions as microprocessor 10 described with reference to FIG. 1; in FIG. 1, the interface devices are included within block 10. The program memory 66 which preferably is a read-only memory stores the operational program. The task of writing the program from the requirements given later herein is well known to one skilled in the art. Microprocessor 52 provides addresses to address bus 56 to fetch instructions from program memory 66 and data from data memory 68 which is a random access memory. Write enable and other control functions are provided from microprocessor 52 to data memory 68 or peripheral interface devices 50 and 64 on control bus 70.

Peripheral interface devices 50 and 64 allow microprocessor 52 to read data from keyboard 30, to test the state of sensors and switches, display the results of internal operations and control the magnetron. Example peripheral interface devices 50 and 64 are MCS6522's which may have pins 21–40 connected to control, timing, interrupt, data bus and address bus. Peripheral interface device 64 provides interface for control panel 72 which includes keyboard 30 and displays 74. Keyboard inputs to the microprocessor are provided by a conventional matrix scan technique. More specifically, the keyboard comprises a matrix of switches which may be of the contact or capacitive touch variety. For the control panel of FIG. 7, a 4×6 matrix would be sufficient; however, a larger matrix will be described and it is assumed that it may contain functions not discussed herein. Output signals are sequentially provided to the columns of the matrix, and the rows are sensed and decoded. In detail, pins 10–17 of MCS6522 are connected to eight lines 76 connected to high current output buffer 80 and segment output port 78. At the output of high current output buffer 80, which may, for example, be a 74LS374, eight lines 82–89 as indicated connect through eight amplifiers 90 to the keyboard. Sequence column scanning pulses are provided on lines 82–89; the rows of the matrix of switches of the keyboard are sensed by lines 92 which are connected to pins 1–9 of peripheral interface device 64. The sensed data is decoded whereby microprocessor 52 determines which switches of the switch matrix of keyboard 30 are closed.

Digital displays 74 are scanned which means that each digit is driven for a short period of time, such as two milliseconds, in sequence. The entire display is scanned at a rate which the eye cannot detect. Lines 82–89 are coupled through driver circuits, two circuits in FIG. 2 being representative of eight in the embodiment. Each conventional circuit as shown comprises Vcc which is typically +5 volts, R1 which may be 1.5 K ohms, R2 which may be 1.0 K ohms, and transistor Q. These sequenced driver circuits determine which digit of the display is activated. The data that determines which segments of a particular digit are on is determined by the output of segment output port 78 which is coupled to lines 94–101 through resistors 103 to displays 74. An example of a segment output port is an MC3482. The data and scan pulses time share lines 76, the enable control to port 78 and buffer 80 being provided on lines not shown by peripheral interface device 50 on pins 3 and 4, respectively.

Microprocessor 52 controls the output of magnetron 12 through peripheral interface device 50. More specifically, outputs from peripheral interface device 50 on lines 104 are connected to high current output buffer 106 which may be, for example, a 74LS374. Two of the outputs of buffer 106 are connected to conventional optical isolators 108 and 110 which may be, for example, MOC3010's. A LOW voltage (logical 0) at the input of an optical isolator causes the internal resistance of its output to be a short circuit.

In response to a control signal from optical isolator 108, triac 40 is turned on energizing heater transformer 44. In response to a control signal from optical isolator 110, triac 42 is turned on energizing the high voltage power supply.

Figure 3:
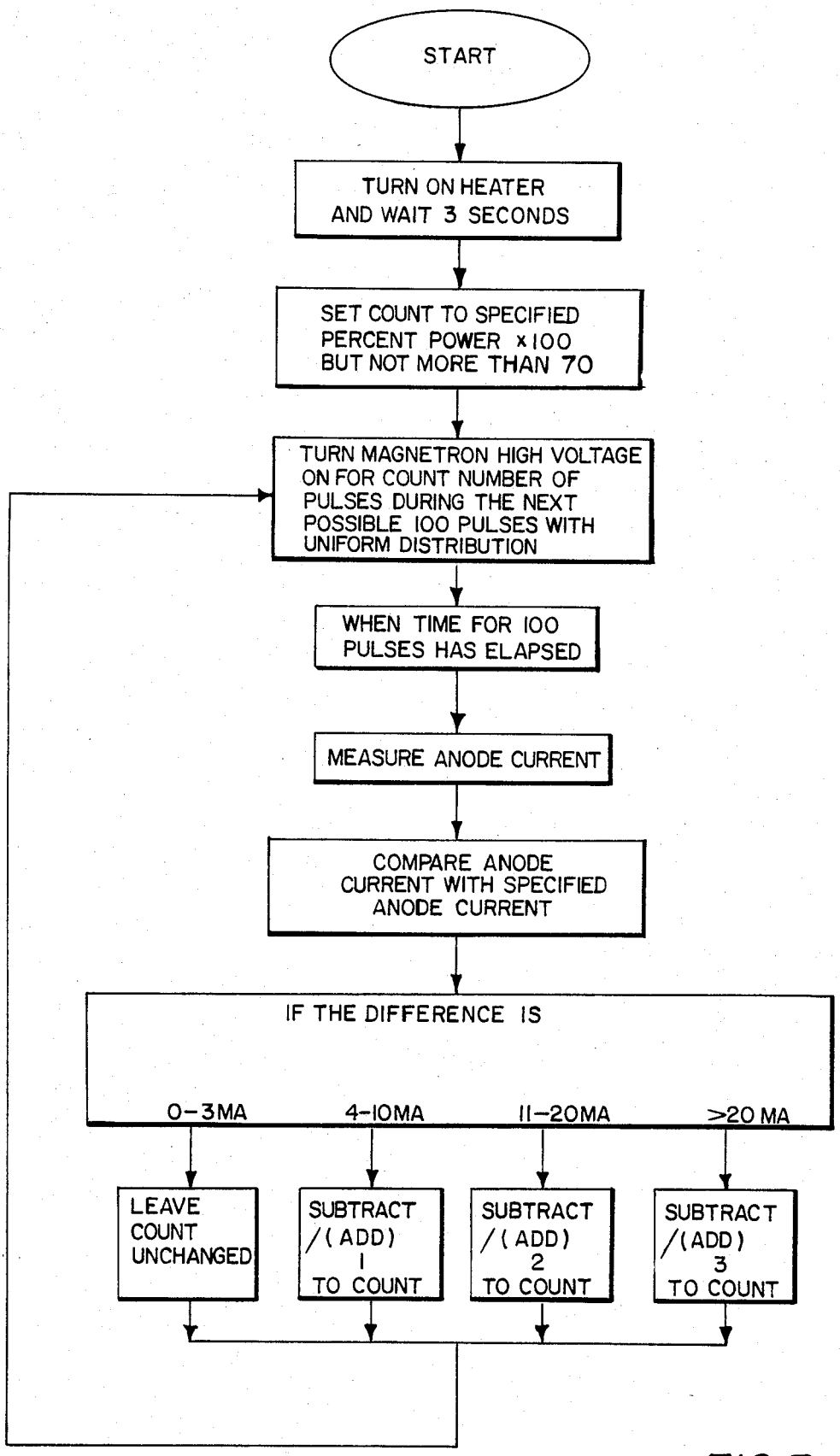
FIG. 3 is a flow diagram of the programming of the microprocessor in accordance with the invention.

FIG. 3 illustrates the logic control of microprocessor 52 of FIG. 2 over magnetron 12. The program of programming memory 66 of the microprocessor in accordance with FIG. 3 and the discussion given herein is well known to those skilled in the art. When the command is given to START the magnetron, microprocessor 52 turns on heater triac 40 through peripheral interface device 50, high current output buffer 106 and optical isolator 108 as described earlier herein. AC current flowing through triac 40 to heater transformer 44 preferably is supplied for more than 3 seconds to heat the cathode prior to supplying the high voltage. If the heater has been energized within the last 3 seconds, the delay may not be necessary. Next, the variable COUNT is set to the specified percent power times 100 but not more than 70. For example, if the operator has selected the oven to operate at half power, COUNT is set to 50 (0.50×100). If the operator has selected the oven to operate at full power, COUNT is set to the maximum initial value of 70. Microprocessor 52 next turns on the high voltage supply triac 42 through peripheral interface device 50, high current output buffer 106 and optical isolator 110. Triac 42 functions as a switch providing ac line voltage to high voltage transformer 46 for COUNT number of ac cycles out of the next 100 cycles. The switching is preferably done at the ac zero current crossing so that high current will not be switched. A conventional zero crossing detector output is supplied to microprocessor 52 to provide the required timing. The active pulses or cycles are distributed uniformly within the next 100-cycle time period so as reduce line current surges and fluctuations. More specifically, if the required duty cycle is greater than 50% (COUNT greater than 50), only one pulse is skipped in sequence. If the required duty cycle is less than 50%, only one pulse will be active in sequence. After 100 ac cycles (1.67 seconds), the anode current is measured by the microprocessor selecting the output of integrator 22 through multiplexer 24 and converting it to a digital signal in analog-to-digital converter for input to peripheral interface device 50. The anode current is then compared to the operator specified anode current. For example, as described earlier herein, full power in the preferred embodiment corresponds to an average anode current of 300 milliamps. Accordingly, if half power had been selected, the specified average anode current would be half of 300 milliamps or 150 milliamps. Further, as described earlier herein, components were selected so that an average anode current of 300 milliamps corresponds to an average voltage of 2.2 volts at the input of multiplexer 24. Accordingly, a 1.1 volt signal at the input of the multiplexer would correspond to an actual anode current of 150 milliamps ([1.1/2.2]×300). If the actual and specified anode currents vary by more than 20 milliamps, COUNT is either increased or decreased by 3 to make the two more equal. If they differ by 11–20 milliamps, COUNT is either increased or decreased by 2 to make the two more equal. If they differ by 4–10 milliamps, COUNT is either increased or decreased by 1 to make them more equal. If they differ by 3 or fewer milliamps, COUNT remains unchanged. Then, the magnetron high voltage is turned ON for COUNT number of pulses during the next possible 100 pulses. In short, the actual average anode current is adjusted to be equal to the specified anode current by appropriately adding or deleting the number of magnetron pulses within sequential 100 pulse or cycle intervals, the adjustment being greater when the two differ by a greater amount. As an example, if full power or an average of 300 milliamps of anode current has been selected, and that corresponds to 94 ac cycles out of 100 for the particular ac line voltage, there would be an initial maximum of 70 pulses of high voltage to the magnetron during the first 100 cycles of ac power. Then, the number of pulses in each 100 cycles would be increased from 70 by 3 until the difference was 20 or less (74 pulses). Then, the number of pulses in each 100-pulse interval would be increased by two until the difference was 10, and so forth.

Figure 8A:
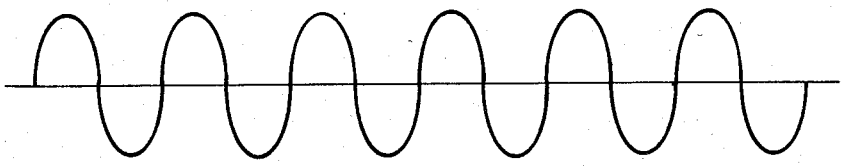
FIG. 8 shows a reference between the ac line cycles, supplied cycles, and anode current drawn.
Figure 8B:
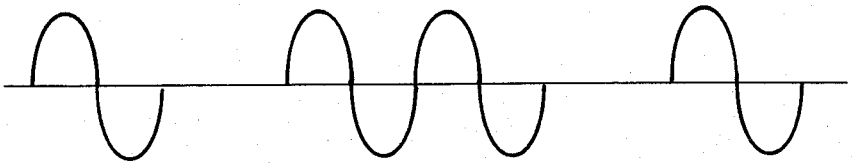
Figure 8C:
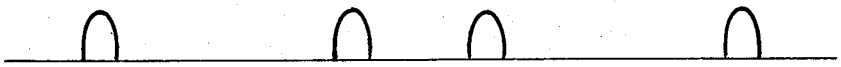

Referring to FIGS. 8*a*–8*c*, there is shown the correspondence between ac line voltage and the anode current drawn by the magnetron. More specifically, FIG. 8*a* provides an ac line reference which typically is 60 or 50 cycles per second depending on the country. FIG. 8*b* is an example of the ac line voltage that may be supplied to high voltage transformer 46. More specifically, with triac 42 functioning as a switch under the control of microprocessor 52 through interface device 50, high current output buffer 106 and optical isolator 110, the second and fifth ac line cycles of the sequence of FIG. 8*a* are prevented from energizing high voltage transformer 46. It was stated earlier that it is preferable to switch at the zero current crossing. If the load is highly inductive such as the typical microwave oven, the zero current crossing is approximately 90° after the zero voltage crossing. Accordingly, FIG. 8*b* is intended only to be representative of the individual selection of cycles to be passed or deleted. It is noted that heater triac 40 is closed for the entire ac cycle sequence so that heater transformer 44 is continuosly across the ac line. FIG. 8*c* shows the anode current that is drawn by the magnetron. The duty cycle of the pulsed magnetron is typically in the range from 0.25 to 0.35.

It was stated earlier herein the ac line cycles supplied to high voltage transformer 46 during a given time interval are substantially uniformly distributed over the time interval. More specifically, if more than half of the available ac cycles of the time period are to be supplied, it may be preferable that triac 42 functioning as a switch not be open for more than one cycle at a time. Conversely, if fewer than half the available ac cycles of the time period are to be supplied, it may be preferable that triac 42 functioning as a switch not be closed for more than one cycle at a time. Accordingly, the fluctuation or surge on the ac line is thereby minimized. For example, the perceptible flickering of domestic lights is reduced or eliminated. A preferable software algorithm for uniformly distributing the supplied ac cycles over a particular interval is to add COUNT as defined herein to the contents of a register for each available ac line cycle. If the contents of the register is greater than the number of ac cycles in the interval, triac 42 is turned ON for that ac line cycle and the number of cycles in the interval is subtracted from the contents. If the contents of the register is not greater than the number of ac cycles in the interval, triac 42 is not turned ON for that ac line cycle. Although an interval of 100 ac line cycles was described earlier herein, other length intervals may be used as well; in fact, the quicker response time of shorter intervals may be preferable in certain application. The Appendix shows a table derived using the above described software algorithm and the time base interval of 60 cycles. It shows that the ON cycles are substantially uniformly distributed over the time interval. The "O"'s represent triac 42 being open for the particular ac line cycle so that the high voltage transformer is not energized. The "X"'s represent the triac 42 being closed for the particular ac line cycle so that the high voltage transformer is energized. For COUNT 36, for example, 36 out of the 60 available cycles in the interval are to be supplied to the high voltage transformer and they are to be distributed over the 60 cycle interval of one second. COUNT 36 is added to the register and because the contents is less than 60, the function of triac 42 is an open switch for the first ac line cycle. Next, COUNT 36 is added to the register resulting in 72. Because 72 is greater than 60, the function of triac 42 for the second ac line cycle is a closed switch and then 60 is subtracted from the total leaving 12. For the third ac line cycle, COUNT 36 is added to the register value of 12 providing a sum of 48. Because that is less than 60, the function of triac 42 is an open switch. This process continues for the entire interval which for this example is equivalent to 60 ac line cycles or one second. Then, a new COUNT is calculated as described with reference to FIG. 3 and the process continues.

Figure 4:
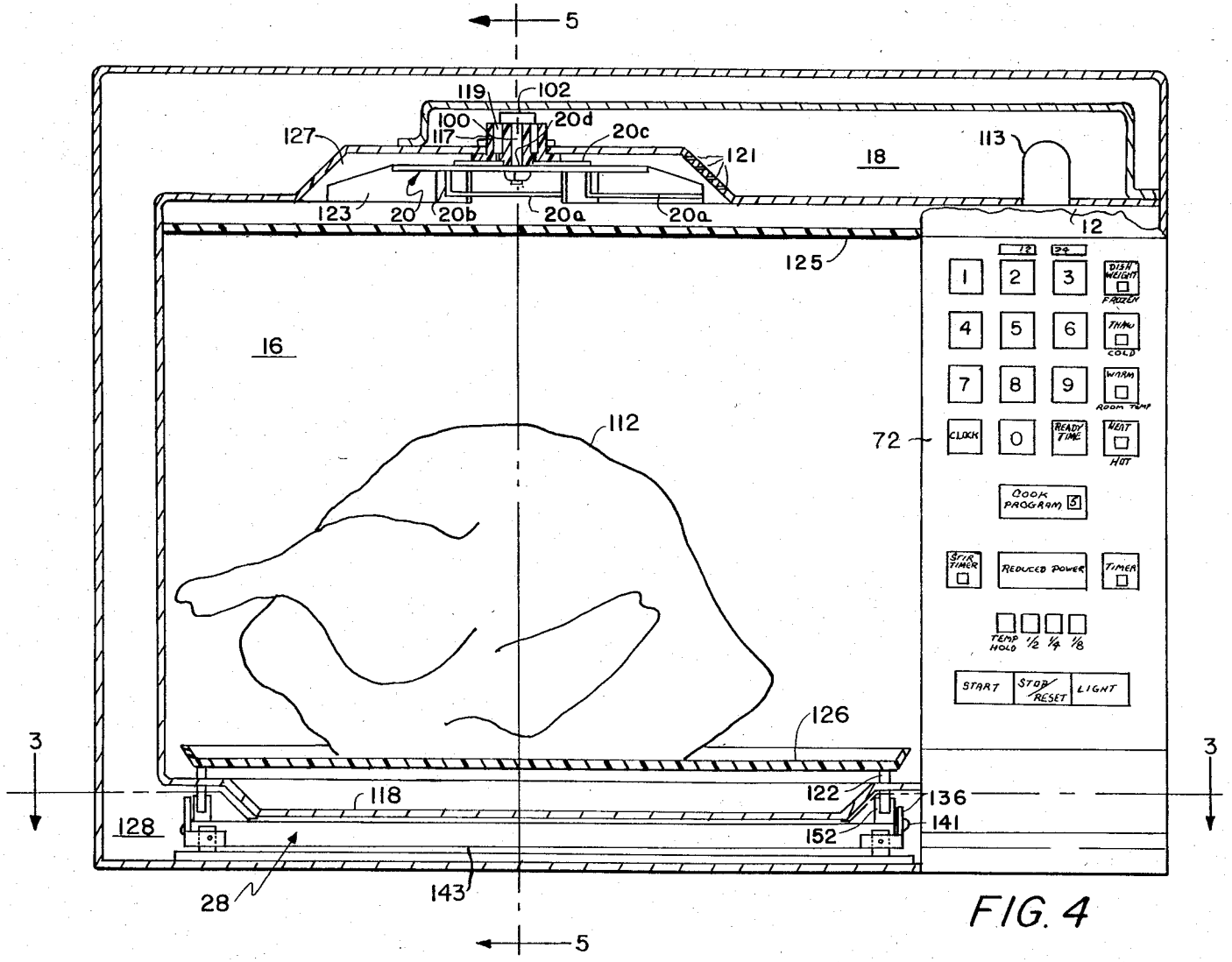
FIG. 4 is a partially cut away view of a microwave oven having a scale.
Figure 5:
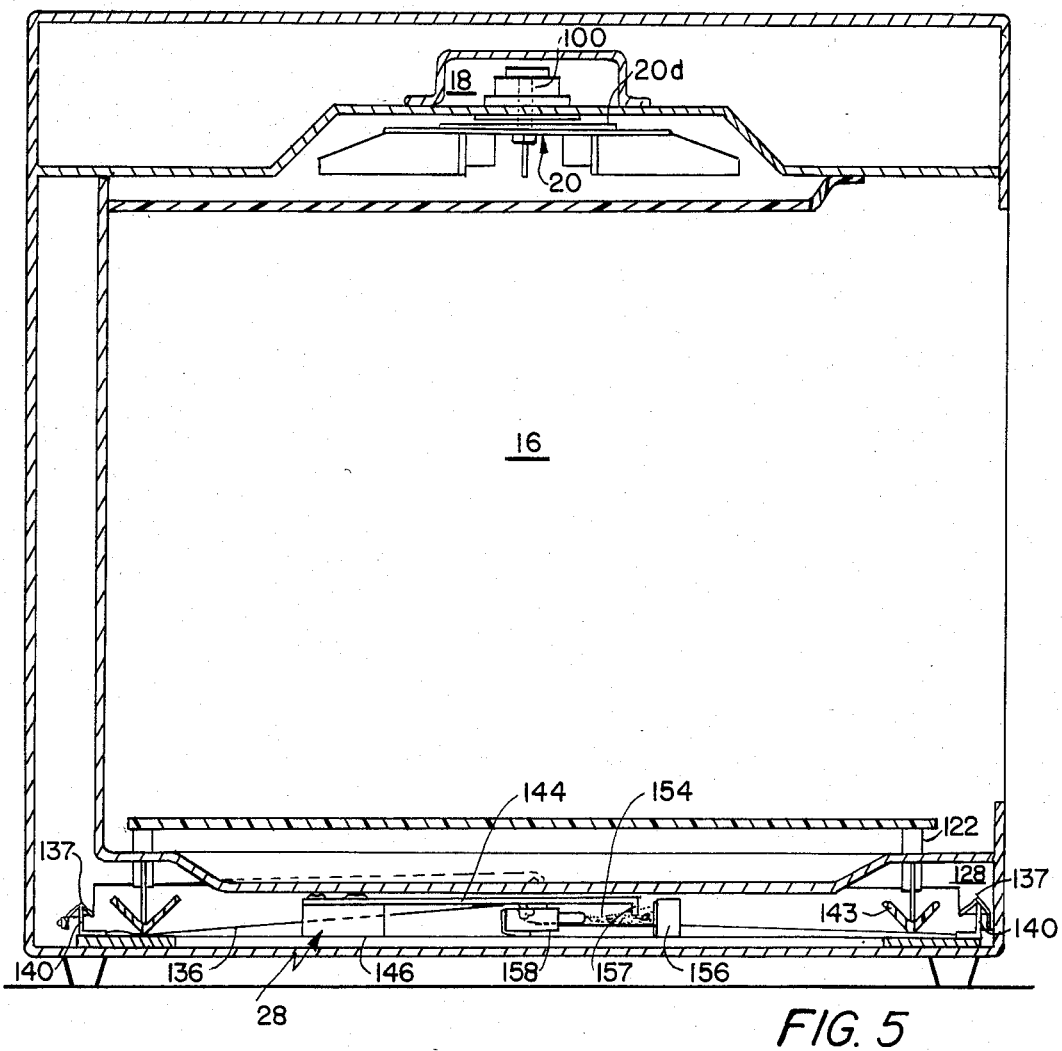
FIG. 5 is a view taken along line 5—5 of FIG. 4.
Figure 6:
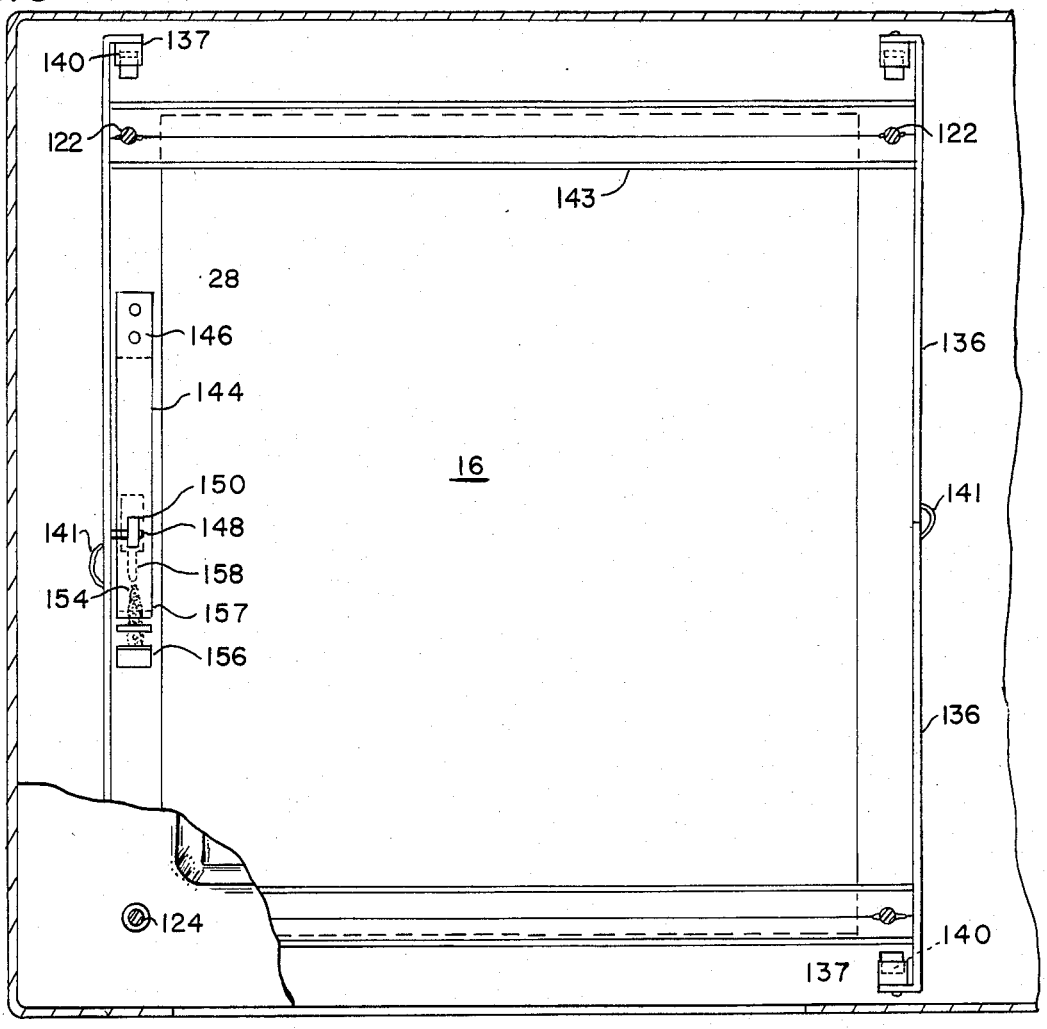
FIG. 6 is a partially cut away top view of FIG. 4.

Referring to FIGS. 4, 5, and 6, there are respectively shown partially cut away front elevation, side and top views of a microwave oven having a scale 28 for using the invention to advantage. Heating cavity 16 contains a food body 112 positioned therein through an access opening provided by a door (not shown). Many well known and conventional parts such as, for example, the door seal structure are not shown as they form no part of the invention. It is preferable that microwave energy at 2450 MHz from a conventional magnetron 12 be coupled through waveguide 18 to a rotating primary radiator 20 which has a pattern characterized in that a substantial portion of the energy is absorbed by the food before being reflected from the walls of the cavity. More specifically, primary radiator 20 comprises a two-by-two array of antenna elements 20*a* where each element is an end driven half wavelength resonating antenna element supported by a length of conductor 20*b* perpendicular to the elements and the upper wall of the microwave oven cavity. Parallel plate microstrip transmission lines 20*c* connect each of the support conductors to a center junction 20*d* axial to rotation. At the junction, a cylindrical probe antenna 100 is attached to the radiator 20 structure. Probe antenna 100 which has a capacitive hat 102 is supported by a plastic bushing 117 positioned within the waveguide. The bushing permits rotation of the probe antenna and radiator around the axis of the probe antenna. Microwave energy introduced into waveguide 18 by output probe 113 of magnetron 12 excites probe antenna 100. Energy couples down probe antenna 100 which functions as a coaxial conductor through hole 119 in the upper wall of the oven cavity. The upper wall of cavity 16 is shaped to form a dome 127 having a flattened conical shape extending outwardly in the wall to provide a nearly circular recess partially surrounding the directive rotating radiator and provide uniform energy distribution in the product being heated. The dome returns microwave energy reflected from the food body toward a circular area in the middle area of the microwave oven cavity. It is preferable that air from a blower (not shown) used to cool the magnetron be circulated through the cavity to remove vapors. It may be preferable that this air be channeled into waveguide 18 and passed through apertures 121 in the wall of the dome to provide rotation of radiator 20. Radiator 20 is connected to fins 123 to provide a suitable force for the air driven rotation. The fins may be fabricated of a plastic nonlossy material. Other paths may also be used to direct the air from the blower to the fins. Also, in lieu of the air driven method, an electric motor (not shown) may be used to provide rotation of the radiator. Grease shield 125 is transparent to microwave energy and provides splatter isolation from the rest of the cavity.

Figure 7:
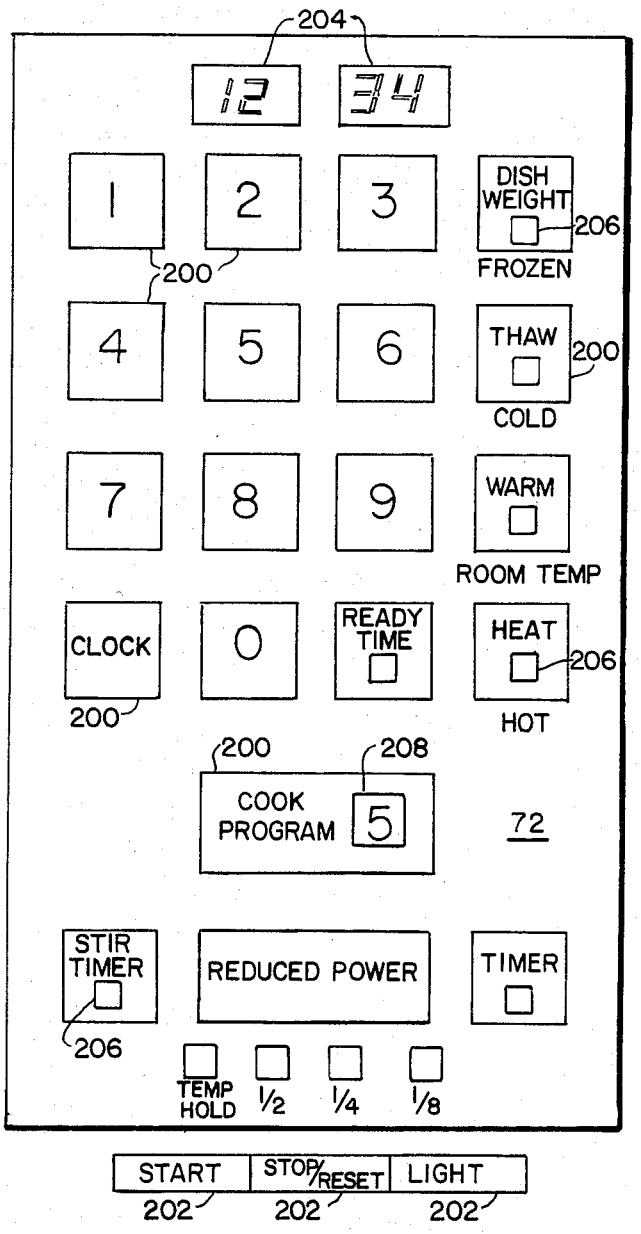
FIG. 7 is a view of the control panel of FIG. 4.

Control panel 72 which is shown in detail in FIG. 7 provides keyboard functions which are inputs to the control microprocessor 52 and display functions by which the microprocessor indicates status to the user. Any of a number of conventional keyboard switches and displays could be used. It may be preferable that well known capacitor touch pad switches be used for the keyboard. Also, it is preferable that the display provide digital read out of parameters such as time and a simultaneous indication of what keyboard entries have been selected. Specific preferable functions of the control panel will be described in detail later herein.

Positioned below the floor 118 of the cavity is scale 28. The scale has four vertical support pins 122 which respectively protrude through holes 124 in the floor of cavity 16 in the proximity of the corners. Supported on the pins is plate 126 which rests approximately one inch above the floor of the cavity at the corners. Typically, the plate is made of a pyrex glass material which is transparent to microwaves. The microwaves pass through the glass, strike the floor of the cavity and are reflected back up into the food body from the bottom side. This allows the microwave energy to enter the food body from all sides. Also, the plate may provide some protection for the magnetron if the oven is accidentally turned on when there is no load in the cavity. Although the glass plate may be removed for cleaning, it should always be in the oven during operation. The weight of the glass plate and any food bodies and dishes placed thereon is transferred through support pins 122 to scale 28.

It is desirable that substantially no microwave energy pass through the four pin holes 124 into chamber 128 below the cavity which houses the scale. Accordingly, the pin holes 124 which may preferable be circular, are less than one half wavelength in circumference. More specifically, the holes are slightly larger than the pins which are approximately one quarter inch in diameter. To minimize inaccuracies in scale weighings, it is important that there be as little friction as possible for a pin as it moves up and down through a hole; this may be accomplished by selecting tolerances that accurately position the pins to be concentric with their respective holes and by using materials that have low coefficients of friction. It is preferable that the pins be fabricated of a microwave transparent material such as a ceramic to provide a microwave choke through the holes. If a pin were metallic, the structure would exhibit the properties of a coaxial line with the outer conductor being the surface of the hole and the center conductor being the pin. Microwave energy would pass even though the size of the outer conductor was below cutoff.

Scale 28 comprises four rigid lever arms 136. Each lever arm has an inverted V-bracket 137 on one end to support the arm from a knife edged fulcrum 140. At the other end, each arm is attached to a second arm by a semicircular pivot pin 141 so that there can be vertical motion at the joint of the arm pair between the fulcrums at the opposite ends. The pairs of lever arms 136 so described are positioned parallel to each other so that each arm of the pair has a corresponding arm in the other pair. The corresponding arms are rigidly attached by a V shaped cross bar 143 running perpendicular to the connected lever arms. In the disclosed embodiment of scale 28 used to advantage with the invention, each arm is approximately seven inches long and the cross bars which are fourteen inches long are attached approximately one inch from the fulcrums. The scale was designed with these dimensions so that it would fit in chamber 128 and the pins would protrude through holes 124 at appropriate places. The compliant member 144 which resists downward motion of the lever arms at the pivot pin 141 joint is a flexible metal strip that is supported in cantilever fashion from block 146. Rod 148 is attached rigidly and perpendicular to one of the lever arms near the pivot pin joint. The rod has a disk 150 on the end which rests on compliant member 144.

As described earlier herein, the weight of plate 126 and any objects placed theron is transferred to the scale by pins 122 which protrude into the cavity through holes 124 in the bottom cavity wall. Pins 122 are attached to rectangular brackets 152 which limit the upward movement of the pins through holes 124. The rectangular brackets 152 are rigidly connected at inside bottom points of V-shaped cross bars 143 adjacent to the respective lever arms. Regardless of the distribution of downward force between the four pins 122, the force is transferred in approximately the same ratio by the cross bars to the lever arms on the compliant member side of the scale. Rod 148 couples the force from the lever arms through disk 150 to the compliant member 144. As the weight and corresponding downward force is increased, the flexible compliant member bends more; the compliant member is analogous to a spring. The vertical position of the unsupported end of the compliant member is therefore a function of the weight exerted on pins 122. The unsupported end of compliant member 144 is bent downward to form a shade member 157 that shields a particular portion of light beam 154 from being incident on light sensitive device 156. As the weight on plate 126 is increased so that the unsupported end of compliant member 144 bends further downward, a greater portion of the light beam is blocked from being incident on light sensitive device 156. Light sensitive device 156 may preferably be a phototransistor which provides an analog voltage which is a function of the light incident upon it. The source 158 of the light beam 154 may be a light bulb as shown or more preferably a light emitting diode. It may be preferable to position a concave lens between the source of light and the light sensitive device to focus the beam of light to a relatively small area. Accordingly, the intensity within that area would be varied rather than varying the area of light incidence.

Scale 28 provides a means for providing microprocessor 10 (or microprocessor 52 of FIG. 2) with an input indicative of the weight of objects in cavity 16. A substantial advantage of scale 28 so described is that it can be installed in commercially available microwave ovens without significant retooling. More specifically, in the particular microwave oven to which the scale was embodied, chamber 128 had a height of $\frac{3}{8}$ inches in the center and approximately 1 ½ inches at the corners and edges. FIGS. 4, 5, and 6 have not been drawn to scale. The corners and edges of the floor 118 of cavity 16 have always been raised so that a food body supported on plate 126 would be elevated from the conductive surface of the floor where dielectric losses would be very low. The scale which has a height of approximately one inch has its structure in a rectangular shape with nothing in the center so that it fits around the perimeter of chamber 128 where the height is approximately 1 ½ inches. Furthermore, because there is no structure in the center of the scale, it can be adapted for use in a bottom fed microwave oven.

The reference clock for microprocessor 52 is provided by clock 60. Conventionally, clock 60 comprises an AC filter connected to the 60 Hz AC power line and a zero crossing detector, the output of which is coupled to the microprocessor.

Referring to FIG. 7, there is shown an expanded view of control panel 72 which comprises keyboard 30 and display 74. As stated earlier herein, it may be preferable that the keyboard switches be conventional capacitive touch pad switches. Typically, a touch panel interface may be connected between the keyboard and the microprocessor; the interface is of conventional design and is included in many commercially available microwave oven models. Similarly, a high voltage driver interface may be connected between the microprocessor and displays of control panel 72 to provide lighted indicators. The keyboard includes touch pads 200 numerically labeled 0–9, functionally labeled CLOCK, READY TIME, DISH WEIGHT, THAW, WARM, HEAT, COOK PROGRAM, STIR, TIMER, REDUCED POWER, TIMER, and push switches 202 labeled START/RESET and LIGHT. The display includes digital read outs 204, function indicator lights 206 associated with functionally labeled touch pads, and digital read out 208 associated with the COOK PROGRAM function pad.

In operation, touch pads labeled 0–9 may generally be used conventionally to enter data for well known functions into the microprocessor. For example, when the microwave oven is not being used, digital read outs 204 display the time of day. To change the time of day, the user pushes numerical pads corresponding to the desired time; this time is displayed in digital read outs 204. Then, when the user pushes CLOCK, the displayed time is entered into the microprocessor and becomes the new time of day. Another example is to use the numerically labeled pads to display the amount of time food is to be cooked. Upon pushing START, the display time counts down until the oven shuts off. The THAW function pad is used to activate the microprocessor to control the magnetron so that the food is raised from frozen food at 0° F. to thawed food at 40° F. The WARM function pad is used to activate the microprocessor to control the magnetron so that the food is raised from 40° F. to 65° F. The HEAT function pad is used to activate the microprocessor to control the magnetron so that the food is heated from 65° F. to 160° F. The COOK PROGRAM function pad is used to activate the microprocessor to control the magnetron so that the food at 160° F. is taken through the cooking process which may or may not raise its temperature to above 160° F. In other words, the THAW, WARM, HEAT and COOK inputs are indicative of the initial temperature of the food. Before initiating cooking, the COOK PROGRAM which is appropriate for the particular food being cooked may be selected by touching an appropriate numerical pad and then touching COOK PROGRAM. The selected program is displayed in digital read out 208. When in a cook-by-weight mode which will be described in detail herein, the REDUCED POWER pad may be touched to activate TEMP HOLD which decreases the duty cycle of the magnetron. The ½, ¼ and ⅛ indicators are activated by successive touchings of the REDUCED POWER pad during conventional cook-by-time operation. The READY TIME function pad is used to program the microwave oven to come on at a future time. The STIR TIMER is used to sound an alarm and shut off the oven at a time when the food is to be stirred or other action taken within the oven. The TIMER function is used as a count down clock to an alarm for timing which may or may not be associated with the microwave oven. The START button initiates execution of a particular selected programmed subroutine which turns the magnetron on. The STOP/RESET button causes the magnetron to be turned off. Successive pushings of the LIGHT button causes a light (not shown) illuminating the cavity to be turned on and off.

The programming of the microprocessor to regulate the output power of the magnetron has been described earlier herein. It has been stated that the inventive principle has particular advantage when used in combination with a microwave oven having a scale coupled to the cavity wherein cooking times are calculated from the initial weight of the food in the cavity and an operator input relating to the initial temperature of the food. As described with reference to FIGS. 1 and 2, an analog signal corresponding to the initial weight of the food is sampled by the microprocessor. The programming of the microprocessor which is known to those skilled in the art will now be described for the calculation of cooking times. It should be understood that the microprocessor may preferably perform many other functions than the ones described herein. For example, the microprocessor may monitor a temperature probe, monitor an interlock, cook for a set time, and cook at a set power.

The following equation is used to CALCULATE HEATING TIMES.

$$\text{Heating Time} = \frac{[HUS]\,[FW + (DW)\,(SHD)]}{[OPL]\,[PLS]\,[CF]}$$

where HUS is Heat Units Selection, FW is Food Weight, DW is Dish Weight, SHD is Specific Heat of Dish, OPL is Oven Power Level, PLS is Power Level Selection and CF is Coupling Factor.

The first term in the heating time equation is Heat Units Selection which is expressed in BTUs per pound of food. It has been found that the required heat units per weight unit of food is in part a function of the temperature range over which the food is to be heated and chemical and/or physical changes taking place within the food. By a very simplified user input from the keyboard, this term of the equation is determined. More specifically, referring again to FIG. 7, the user indicates the initial temperature state of the food by touching THAW which as labeled is for frozen foods (0° F.), WARM which as labeled is for cold foods (40° F.) such as out of the refrigerator and/or HEAT which as labeled is for food at room temperature (65° F.). Touching of more than one of these pads initiates a separate cycle for each function and a separate calculation of the heating time equation for each cycle. For the Thaw cycle, 100 BTUs per pound is entered into the equation; for the WARM cycle, 25 BTUs per pound is entered into the equation; for the HEAT cycle, 100 BTU's per pound is entered into the equation; and for the COOK cycle, 25–250 BTUs per pound is entered into the equation depending on the COOK PROGRAM that is selected by touch pads and that is displayed within the COOK PROGRAM touch pad. Although the Heat Units Selection entry into the equation for COOK determines the heating time for a maximum power level, that time will be increased by a specific factor if a REDUCED POWER setting is selected. In other words, the same number of BTUs for the cooking task are delivered but over a longer period of time for more delicate cooking or simmering.

The second term in the heating time equation is [Food Weight +(Dish Weight) (Specific Heat of Dish)]. The presence of the Food Weight in the equation is obvious; the multiplication of its units (pounds) by the units of Heat Units Selection (BTU per pound) yields BTUs for the numerator of the equation which when divided by the units (BTUs per minute) of the denominator, gives the quotient in minutes which are the desired units. The inclusion of (Weight Dish) (Specific Heat of Dish) is to compensate for a certain portion of the heat which is provided to the food being transferred to the dish by conduction. In other words, more heat must be delivered to the food than might be thought necessary because some of it is lost by conduction to the dish. For user simplicity, the specific heat of the dish in the calculation of the heating time equation is assumed to be a constant of 0.2 for the WARM and HEAT cycles where the temperature of the dish is raised by conduction as the temperature of the food rises. For the THAW and COOK cycles, the specific heat of the dish is set equal to zero to eliminate the product of it and dish weight from the equation; with THAW, the BTUs transferred to raise the temperature of the dish is insignificant compared to the BTUs to thaw the food and with COOK, which starts at 160° F., there is no appreciable rise in temperature. Although a more exacting expression of the heat lost by the food (and accordingly the additional heat required to be delivered to it) would also include the specific heat of the food and heat rise in gases in the cavity, empirical analysis has showed that the assumptions were adequate for proper operation of the oven using the heating time equation. In operation, when the light indicator on the DISH WEIGHT pad is on, it is indicative that a dish weight is stored in the microprocessor. Therefore, to commence a new cooking process with a new dish, the DISH WEIGHT pad is touched and the light indicator goes out; this erases the previous dish weight from the microprocessor memory and "zeros the scale". The weight of the dish may then be set up for entry into the microprocessor by either entering it through the numerical touch pads if it is known or by placing the dish without food in the oven where it depresses the scale. With a second touching of the DISH WEIGHT pad, the indicator light thereon goes on indicating that the new dish weight has been entered into the microprocessor. It may be preferable that the analog voltage at the output of light sensitive device 156 be somewhat linear with the weight that is placed on the scale. With this being the case, a linear analog to digital converter properly scaled can be used so that the microprocessor directly samples weight in pounds. If the analog voltage is not linear with weight such as being inversely proportioned as the embodiment of FIG. 4, it can be compensated for in the microprocessor by such conventional techniques as a lookup table. For accuracy of weighing, it may be preferable that at a weighing time, the microprocessor take a plurality of weight samples, discard high and low weights, and average the remainder of the weights. The weight of the food is calculated by the microprocessor by using the weighing immediately prior to the START button being pushed and subtracting the weight of the dish after zero adjustment.

The first term in the denominator of the heating time equation is Oven Power Level. In a cook-by-weight oven developed before the output power regulation system disclosed herein, the output power had to be roughly estimated because it varied considerably from oven to oven; further, with a particular oven, the output power varied as a function of the AC line voltage. In short, there were significant errors in the calculated cooking times that resulted from not accurately knowing the output power. In accordance with the inventive principle of regulating the power supplied to the magnetron, the term Oven Power Level is accurately known because for full power, the anode is held constant at 300 milliamps which corresponds to 725 output power or 41.2 BTUs per minute.

The second term in the denominator of the heating time equation is Power Level Selection. If the REDUCED POWER pad has not been used to select TEMP HOLD, a value of 1 is used for PLS in the heating time equation. If the REDUCED POWER pad has been used to select TEMP HOLD, 0.3 plus 0.04 per pound of food is input to the equation. For example, if the food weights one pound, the magnetron will operate at 34 percent of full power. Further, if the food weighs two pounds, 38 percent of full power will be outputted. This is implemented by decreasing the duty cycle of the magnetron. In the past, it was generally accepted that just as some foods cook better conventionally at lower rather than higher temperatures, some foods cook better at reduced microwave energy power levels. Accordingly, most microwave ovens provide many power level selections. As part of the development of the cook-by-weight process, it was found most important to determine the total number of BTUs required for the particular food and then deliver them; however, the rate at which microwave energy is supplied is not so critical. In fact, the TEMP HOLD feature provides only one reduced power level setting and that is a function of the weight of the food. Generally, the reduced power of TEMP HOLD is used to best advantage with food having a large volume where the microwave energy penetration to the center of the food is greatly reduced. Additional cooking time may be desirable to permit heat in the outer portion of the food to conduct toward the center for more uniform heating and cooking. It has been found that the most appropriate reduced power setting is one which holds the food at temperature which for lightweight foods is approximately 30 percent of full power. The additional 4 percent per pound in the PLS formula compensates for larger food bodies having greater surface areas and therefore greater heat losses that must be compensated for to maintain temperature. The assumption that food surface and size generally relates to weight has been empirically tested.

The last term of the heat time equation is Coupling Factor. Not all of the microwave energy output from the magnetron is coupled into the food. Some of the energy is lost in the system such as in the walls, waveguide, and the plate. The percent of total energy that is converted into heat in the food is in part a function of the food surface area and its absorptivity. For example, if one potato takes four minutes to cook, two potatoes will generally take less than eight minutes or twice that. This is because as the load is increased, a larger percentage of the total power is absorbed by the food. It has been found that the distribution of energy into the food with respect to losses is approximately expressed by the following formula.

$$\text{Coupling Factor} = \frac{\text{Food Weight}}{\text{Food Weight} + K}$$

In essence, the constant K can be viewed as losses of the oven expressed in terms of weight. Constant K has been assigned the value of 0.1. Accordingly, if the food weighs 0.1 pounds, the coupling factor is one half or the heating time is increased by a factor of 2 over which it would have otherwise been. If, however, the food weighed 1.0 pounds, the heating time would only be increased by a factor of 1.1. In FIG. 1, the block for a microprocessor block 10 indicates that the heating time per weight unit decreases as a function of increasing weight because of the improved coupling of microwave energy into the greater food mass.

This concludes the description of the Preferred Embodiment. The reading of it by one skilled in the art will bring to mind many modifications and alterations without departing from the spirit and scope of the invention. Accordingly, it is intended that the scope of the invention be limited only by the appended claims.

APPENDIX

```
OOOOOOOOOOOOOOOOOOOOOOOOOOOOOOOOOOOOOOOOOOOOOOOOOOOOOOOOOOOOOOOOOOOOO   COUNT = 0
OOOOOOOOOOOOOOOOOOOOOOOOOOOOOOOOOOOOOOOOOOOOOOOOOOOOOOOOOOOOOOOOOOOOX   COUNT = 1
OOOOOOOOOOOOOOOOOOOOOOOOOOOOOXOOOOOOOOOOOOOOOOOOOOOOOOOOOOOOOOOOOOOOX   COUNT = 2
OOOOOOOOOOOOOOOOOOOXOOOOOOOOOOOOOOOOOOOOOXOOOOOOOOOOOOOOOOOOOOOOOOOOX   COUNT = 3
OOOOOOOOOOOOOOOXOOOOOOOOOOOOOOOXOOOOOOOOOOOOOOOXOOOOOOOOOOOOOOOXOOOOOX   COUNT = 4
OOOOOOOOOOOOXOOOOOOOOOOOOOXOOOOOOOOOOOOOXOOOOOOOOOOOOOXOOOOOOOOOOOOOX   COUNT = 5
OOOOOOOOOXOOOOOOOOOXOOOOOOOOOXOOOOOOOOOXOOOOOOOOOXOOOOOOOOOXOOOOOOOOX   COUNT = 6
OOOOOOOXOOOOOOOXOOOOOOOXOOOOOOOXOOOOOOOXOOOOOOOXOOOOOOOXOOOOOOOXOOOOX   COUNT = 7
OOOOOOXOOOOOOXOOOOOOXOOOOOOXOOOOOOXOOOOOOXOOOOOOXOOOOOOXOOOOOOXOOOOOX   COUNT = 8
OOOOOXOOOOOXOOOOOXOOOOOXOOOOOXOOOOOXOOOOOXOOOOOXOOOOOXOOOOOXOOOOOXOOX   COUNT = 9
OOOOXOOOOXOOOOXOOOOXOOOOXOOOOXOOOOXOOOOXOOOOXOOOOXOOOOXOOOOXOOOOXOOOX   COUNT = 10
OOOOXOOOOXOOOOXOOOOXOOOOXOOOOXOOOOXOOOOXOOOOXOOOOXOOOOXOOOOXOOOOXOOOX   COUNT = 11
OOOOXOOOOXOOOOXOOOOXOOOOXOOOOXOOOOXOOOOXOOOOXOOOOXOOOOXOOOOXOOOOXOOOX   COUNT = 12
OOOOXOOOOXOOOXOOOOXOOOOXOOOXOOOOXOOOXOOOOXOOOOXOOOXOOOOXOOOXOOOOXOOOX   COUNT = 13
OOOOXOOOXOOOXOOOOXOOOXOOOXOOOXOOOOXOOOXOOOXOOOOXOOOXOOOXOOOOXOOOXOOOX   COUNT = 14
OOOXOOOXOOOXOOOXOOOXOOOXOOOXOOOXOOOXOOOXOOOXOOOXOOOXOOOXOOOXOOOXOOOX   COUNT = 15
OOOXOOOXOOOXOOXOOOXOOOXOOOXOOXOOOXOOOXOOOXOOXOOOXOOOXOOOXOOXOOOXOOOX   COUNT = 16
OOOXOOOXOOXOOOXOOXOOOXOOXOOOXOOXOOOXOOXOOOXOOXOOOXOOXOOOXOOXOOOXOOOX   COUNT = 17
OOOXOOXOOXOOOXOOXOOXOOOXOOXOOXOOOXOOXOOXOOOXOOXOOXOOOXOOXOOXOOOXOOXOX   COUNT = 18
OOOXOOXOOXOOXOOXOOXOOXOOXOOXOOXOOXOOXOOXOOXOOXOOXOOXOOXOOXOOXOOXOOXOX   COUNT = 19
OOXOOXOOXOOXOOXOOXOOXOOXOOXOOXOOXOOXOOXOOXOOXOOXOOXOOXOOXOOXOOXOOXOX   COUNT = 20
OOXOOXOOXOOXOOXOOXOXOOXOOXOOXOOXOOXOOXOXOOXOOXOOXOOXOOXOOXOOXOOXOXOX   COUNT = 21
OOXOOXOOXOXOOXOOXOOXOXOOXOOXOXOOXOOXOOXOXOOXOOXOOXOXOOXOOXOOXOXOOXOX   COUNT = 22
OOXOOXOXOOXOOXOXOOXOOXOXOOXOOXOXOOXOOXOXOOXOOXOXOOXOOXOXOOXOOXOXOOXOX   COUNT = 23
OOXOXOOXOXOOXOXOOXOXOOXOXOOXOXOOXOXOOXOXOOXOXOOXOXOOXOXOOXOXOOXOXOOXOX   COUNT = 24
OOXOXOOXOXOXOOXOXOOXOXOXOOXOXOOXOXOXOOXOXOOXOXOXOOXOXOOXOXOXOOXOXOOXOX   COUNT = 25
OOXOXOXOOXOXOXOOXOXOXOOXOXOXOXOOXOXOXOOXOXOXOOXOXOXOOXOXOXOOXOXOXOXOX   COUNT = 26
OOXOXOXOXOOXOXOXOXOOXOXOXOXOXOXOOXOXOXOXOXOOXOXOXOXOXOOXOXOXOXOXOXOX   COUNT = 27
OOXOXOXOXOXOXOXOXOOXOXOXOXOXOXOXOOXOXOXOXOXOXOXOXOXOXOXOXOXOXOXOXOX   COUNT = 28
OOXOXOXOXOXOXOXOXOXOXOXOXOXOXOXOXOOXOXOXOXOXOXOXOXOXOXOXOXOXOXOXOXOX   COUNT = 29
OXOXOXOXOXOXOXOXOXOXOXOXOXOXOXOXOXOXOXOXOXOXOXOXOXOXOXOXOXOXOXOXOXOX   COUNT = 30
OXOXOXOXOXOXOXOXOXOXOXOXOXOXOXOXOXXOXOXOXOXOXOXOXOXOXOXOXOXOXOXOXOXX   COUNT = 31
OXOXOXOXOXOXOXXOXOXOXOXOXOXOXOXOXOXOXOXOXOXOXOXOXOXOXOXOXOXOXOXOXXX   COUNT = 32
OXOXOXOXOXXOXOXOXOXOXXOXOXOXOXOXOXXOXOXOXOXOXXOXOXOXOXOXOXXOXOXOXXX   COUNT = 33
OXOXOXOXXOXOXOXXOXOXOXXOXOXOXOXXOXOXOXOXOXXOXOXOXOXXOXOXOXOXXOXOXXX   COUNT = 34
OXOXOXXOXOXOXOXOXOXXOXOXOXOXOXOXXOXOXOXOXOXXOXOXOXOXXOXOXOXOXXOXOXXX   COUNT = 35
OXOXXOXOXXOXOXOXXOXOXOXOXOXOXOXXOXOXOXOXOXXOXOXOXOXXOXOXOXOXXOXOXXXX   COUNT = 36
OXOXXOXOXXOXXOXOXXOXOXXOXOXOXXOXOXOXOXXOXOXOXOXXOXOXOXOXXOXOXXOXXXX   COUNT = 37
OXOXXOXXOXOXXOXXOXXOXOXXOXXOXXOXOXXOXXOXOXXOXXXXOXXOXOXXOXXOXXOXXXX   COUNT = 38
OXOXXOXXOXXOXXOXXOXXOXOXXOXXOXXOXXOXXOXXOXXOXOXXOXXOXXOXXOXXOXXOXXXX   COUNT = 39
OXXOXXOXXOXXOXXOXXOXXOXXOXXOXXOXXOXXOXXOXXOXXOXXOXXOXXOXXOXXOXXOXXXX   COUNT = 40
OXXOXXOXXOXXOXXOXXOXXXOXXOXXOXXOXXOXXOXXOXXOXXOXXOXXOXXOXXOXXOXXOXXX   COUNT = 41
OXXOXXOXXXOXXOXXOXXXOXXOXXOXXOXXXOXXOXXOXXXOXXOXXOXXXOXXOXXOXXOXXXX   COUNT = 42
OXXOXXXOXXOXXXOXXOXXXOXXOXXXOXXOXXOXXXOXXOXXOXXXOXXOXXXOXXOXXOXXXXX   COUNT = 43
OXXOXXXOXXXOXXXOXXOXXXOXXXOXXXOXXXOXXXOXXXOXXXOXXXOXXXOXXXOXXOXXXXX   COUNT = 44
OXXXOXXXOXXXOXXXOXXXOXXXOXXXOXXXOXXXOXXXOXXXOXXXOXXXOXXXOXXXOXXXXXX   COUNT = 45
OXXXOXXXOXXXOXXXXOXXXOXXXOXXXXOXXXOXXXOXXXXOXXXOXXXXOXXXOXXXOXXXXXX   COUNT = 46
OXXXOXXXXOXXXOXXXXOXXXXOXXXOXXXXOXXXOXXXXOXXXOXXXXOXXXOXXXOXXXXXXX   COUNT = 47
OXXXXOXXXXOXXXXXOXXXXOXXXXOXXXXXOXXXXOXXXXXOXXXXOXXXXXOXXXXXXXXXX   COUNT = 48
OXXXXOXXXXOXXXXXOXXXXOXXXXXOXXXXXOXXXXXOXXXXXOXXXXXOXXXXXOXXXXXXXX   COUNT = 49
OXXXXXOXXXXXOXXXXXOXXXXXOXXXXXOXXXXXOXXXXXOXXXXXOXXXXXOXXXXXXXXXX   COUNT = 50
OXXXXXOXXXXXXOXXXXXXOXXXXXOXXXXXXOXXXXXXOXXXXXXOXXXXXXOXXXXXXXXXX   COUNT = 51
OXXXXXXOXXXXXXXOXXXXXXXOXXXXXXXOXXXXXXXOXXXXXXXOXXXXXXXOXXXXXXXXX   COUNT = 52
```

APPENDIX-continued

| | |
|---|---|
| O X X X X X X O X X X X X X X X O X X X X X X X O X X X X X X X X O X X X X X X X O X X X X X X X O X X X X X X X | COUNT = 53 |
| O X X X X X X X X X O X X X X X X X X O X X X X X X X X O X X X X X X X X O X X X X X X X O X X X X X X X X X X X | COUNT = 54 |
| O X X X X X X X X X X X O X X X X X X X X X O X X X X X X X X X X O X X X X X X X X X X O X X X X X X X X X X X | COUNT = 55 |
| O X X X X X X X X X X X X X O X X X X X X X X X X X X X O X X X X X X X X X X X X X O X X X X X X X X X X X X X | COUNT = 56 |
| O X X X X X X X X X X X X X X X X X X O X X X X X X X X X X X X X X X X X O X X X X X X X X X X X X X X X X X X | COUNT = 57 |
| O X X X X X X X X X X X X X X X X X X X X X X X X X X X X X X X X X X X X X X X X X X X X X X X X X X X X X X X | COUNT = 58 |
| O X X X X X X X X X X X X X X X X X X X X X X X X X X X X X X X X X X X X X X X X X X X X X X X X X X X X X X X | COUNT = 59 |
| X X X X X X X X X X X X X X X X X X X X X X X X X X X X X X X X X X X X X X X X X X X X X X X X X X X X X X X X | COUNT = 60 |

What we claim is:

1. A microwave oven, comprising:

a microwave cavity;

a magnetron coupled to said cavity;

an ac to dc power supply connected to said magnetron;

means for providing a signal corresponding to the anode current drawn from said power supply by said magnetron; and means responsive to said signal for sequentially calculating the number of ac cycles to be supplied to said power supply during each time interval of a sequence of time intervals and for supplying said calculated number of ac cycles to said power supply, each of said time intervals corresponding to a fixed number of ac line cycles, said supplied ac cycles for each of said time intervals being distributed substantially uniformly over each of said time intervals.

2. The oven recited in claim 1 wherein said calculating and supplying means comprises a microprocessor.

3. The oven recited in claim 1 wherein said supplying means further comprises a switch connected between the ac line and said power supply.

4. The oven recited in claim 1 wherein said fixed number of ac line cycles is fewer than 150 cycles.

5. The oven recited in claim 1 wherein said substantially uniform distribution defines that when more than half the ac cycles are supplied during one of said time intervals, two cycles are not omitted in sequence.

6. The oven recited in claim 1 wherein said providing means comprises a resistor between said power supply and ground.

7. The oven recited in claim 6 wherein said providing means further comprises means for time averaging the voltage across said resistor.

8. A microwave oven, comprising:

a microwave cavity;

a magnetron coupled to said cavity;

an ac to dc power supply connected to said magnetron, said power supply having a high voltage transformer;

means for generating a signal corresponding to the anode current supplied by said power supply to said magnetron;

means responsive to said signal for calculating the number of ac cycles to be supplied to the high voltage transformer of said power supply during a time interval corresponding to a predetermined number of ac line cycles wherein said power delivered is regulated towards a predetermined level; and means for supplying said number of ac cycles to said high voltage transformer of said power supply in substantially uniform distribution over said time interval.

9. The oven recited in claim 8 wherein said calculating means comprises a microprocessor.

10. The oven recited in claim 9 wherein said supplying means comprises a switch connected between the ac line and said high voltage transformer.

11. The oven recited in claim 8 wherein said time interval is shorter than 150 ac cycles.

12. The oven recited in claim 8 wherein said distribution defines that when more than half of the ac line cycles are to be supplied, two consecutive cycles are not omitted from being supplied.

13. The oven recited in claim 8 wherein said providing means comprises a resistor between said power supply and ground.

14. The oven recited in claim 13 wherein said providing means further comprises means for time averaging the voltage across said resistor.

15. The method of regulating the output power of a microwave oven magnetron to a standard output level, comprising the steps of:

supplying a predetermined number of ac cycles to said power supply during a first time period corresponding to a fixed number of ac line cycles, said predetermined number not exceeding 70 percent of said fixed number of ac line cycles, said power supply being connected to said magentron;

generating a signal corresponding to the time averaged anode current drawn by said magnetron from said power supply, said time averaged anode current corresponding to the actual output power of said magnetron;

determining the magnitude of difference between said standard output level and said actual output power of said magnetron;

deriving the number of ac cycles to be supplied to said power supply during a second time period to regulate said actual output power of said magnetron towards said standard output level, the magnitude of regulation being a function of said difference magnitude, said second time period being equal to and following said first time period; and supplying said derived number of ac line cycles during said second time period.

16. The method of regulating the output power of a microwave oven to a standard output level, comprising the steps of:

providing a signal corresponding to the time averaged anode current drawn by the magnetron from the high voltage power supply;

periodically determining the magnitude of difference between a calculated actual output level and said standard output level, said calculated level being derived in response to said signal;

determining in response to said magnitude of difference the number of ac line cycles in the next of a sequence of time intervals to be supplied to said power supply, each of said time intervals being a fixed predetermined number of ac line cycles in length; and supplying said number of cycles substantially uniformly over said next time interval to said power supply.

* * * * *